US005310176A

United States Patent [19]

Berg

[11] Patent Number: 5,310,176

[45] Date of Patent: May 10, 1994

[54] BASKETBALL SHOOTING AND RETURN CENTER

[76] Inventor: David J. Berg, 344 N. 190th St., Seattle, Wash. 98133

[21] Appl. No.: 765,331

[22] Filed: Sep. 27, 1991

[51] Int. Cl.[5] ..... A63B 69/00; A63B 63/08

[52] U.S. Cl. ..... 273/1.5 A

[58] Field of Search ..... 273/1.5 R, 1.5 A, 397, 273/371; D21/201

[56] References Cited

U.S. PATENT DOCUMENTS

| | | | |
|---|---|---|---|
| D. 216,684 | 3/1970 | Haubert | D21/201 X |
| D. 280,755 | 9/1985 | Cochran | D21/201 |
| 1,574,201 | 2/1926 | Lynch | 273/397 |
| 1,757,350 | 5/1930 | Wallace | 273/1.5 R |
| 2,893,734 | 7/1959 | Tarte, Jr. | 273/1.5 R X |
| 3,467,377 | 9/1969 | Miller et al. | 273/1.5 R |
| 3,598,407 | 8/1971 | Sorensen | 273/1.5 R |
| 3,917,263 | 11/1975 | Wiley | 273/1.5 A |
| 4,013,292 | 3/1977 | Cohen et al. | 273/371 |
| 4,266,763 | 5/1981 | Collins | 272/3 |
| 4,266,764 | 5/1981 | Collins | 272/3 |
| 4,268,029 | 5/1981 | Collins | 272/3 |
| 4,538,808 | 9/1985 | Holland | 273/1.5 |
| 4,697,810 | 10/1987 | Mathison | 273/1.5 |
| 4,786,371 | 11/1988 | Postol | 273/1.5 A |
| 4,838,549 | 6/1989 | Woodall | 273/1.5 A |
| 4,913,431 | 4/1990 | Jakobs | 273/1.5 |
| 4,955,605 | 9/1990 | Goldfarb | 273/1.5 A |
| 5,016,875 | 5/1991 | Joseph | 273/1.5 A |
| 5,133,546 | 7/1992 | Matherne et al. | 273/1.5 A |

OTHER PUBLICATIONS

Proposal for Net Retrieval System Phototype, presented at Coaches Meeting, Kings High School, Seattle, Wa. in Mar., 1990.

*Primary Examiner*—Paul E. Shapiro

*Attorney, Agent, or Firm*—Christensen, O'Connor, Johnson & Kindness

[57] ABSTRACT

A basketball shooting and return center (10) having a backboard structure (12) on which are mounted a plurality of baskets (14). A ball return table (16) is mounted to the backboard structure below the baskets. The ball return table is formed to define a plurality of ball return troughs (42), each associated with at least one basket. Balls shot at a basket are captured in the associated trough and funnelled to an associated tubular ball rack (110), pivotably secured adjacent each trough, for return to the player. The position of the ball racks can be adjusted to select a desired location remote from the baskets for return of the balls. The center enables players to shoot at baskets disposed at different distances and angles relative to the player while the player remains in a single position.

16 Claims, 9 Drawing Sheets

BASKETBALL SHOOTING AND RETURN CENTER

FIELD OF THE INVENTION

The present invention relates to athletic training devices and, more particularly, to devices for training basketball players to shoot baskets from a variety of different distances and angular positions relative to the basket.

BACKGROUND OF THE INVENTION

In order to develop accurate shooting skills, basketball players spend many hours practicing shooting balls at baskets. When practicing with a conventional single backboard and basket, the player must repeatedly move towards and away from the basket to retrieve the ball after each throw. Thus, the number of shots actually taken during a practice period is reduced by the necessity of travel.

Conventional devices have been developed to retrieve balls after they are shot at a basket, and return the balls to the player to eliminate movement toward and away from the basket, thus increasing the intensity of shooting practice. One such device is disclosed by U.S. Pat. No. 4,913,431 to Jakobs. Jakobs discloses a retrieval and return device consisting of a single funnel-shaped retrieval net, mounted on a wheeled cart, that is positionable underneath a basket. The balls captured within the net are funnelled through an elbow-shaped tube onto an elongate duct that extends away from the basket toward the player's shooting position.

Another retrieval device is disclosed by U.S. Pat. No. 4,697,810 to Mathison, which discloses a paneled enclosure that is positionable around a backboard and basket. Selected panels on the enclosure may be opened to enable shooting at a selected angle relative to the basket. The paneled enclosure supports a collection funnel positioned beneath the basket to receive the balls and return them to the player.

While such conventional single basket devices enable a player to eliminate the time otherwise spent traveling to and from the basket, the devices do not permit a player to vary his or her distance from the basket or his or her angular orientation relative to the basket unless the player moves laterally between shots. If the player moves position for a more complete practice, time and energy is wasted during lateral movement. Further, as these prior devices include only one basket, the number of players which can practice at any one time is limited, and the number of players a coach can simultaneously observe, or video-tape, is also limited.

Finally, the above noted conventional floor mounted devices are relatively large. If a number of devices are to be used to permit practice by more than one player, a large area of gymnasium floor space is taken up, potentially interfering with other practice or game activities. After practice, the devices must be moved for storage if floor space is to be freed up.

SUMMARY OF THE INVENTION

In order to increase the efficiency of shooting practice available over that offered by conventional return devices, the present invention provides a basketball shooting and return center including a backboard structure, a plurality of goals mounted on the backboard structure, and a ball return mechanism associated with the backboard structure for capturing balls thrown by a user at the goals and returning the captured balls to the user.

In a further aspect of the present invention, the ball return mechanism comprises a ball return table, including a peripheral frame secured to the backboard structure under the goals and a web spanning and attached to the frame. The ball return table is configured to form a plurality of troughs, each trough disposed under at least one associated goal and sloping downwardly towards a discharge point defined by the trough.

In a still further aspect of the present invention, the basketball shooting and return center includes at least one elongate ball rack, and preferably more than one ball rack, secured to the ball return table adjacent the discharge points of associated troughs, for directing returned balls to the user at a point remote from the ball return table. The ball racks are preferably pivotally secured to the ball return table on a pivot axis and are selectively securable at desired angular positions about the pivot axis corresponding to desired shooting positions.

A shooting and return center constructed in accordance with the present invention includes a plurality of basket goals from which balls are retrieved by a common ball return table. The multiplicity of baskets and common return mechanism enables a player to stand in one position while shooting balls at baskets disposed at varying distances and angular orientations relative to the player. Thus the player can rapidly make a series of shots to practice shooting under differing conditions of distance and angular orientation, without the need to change position in between shots. However, if a player does change position, a combination of new basket angles and distances for shooting practice is achieved.

In a further aspect of the invention, the baskets are mounted on a common elongate backboard terminating in opposing orthogonal sideboards. The orthogonal sideboards present additional shooting angles to players without increasing the overall size of the shooting center.

Basketball shooting and return centers constructed in accordance with the present invention thus afford a very efficient and intense workout while requiring a minimum of space, as the plurality of goals are integrally mounted on a common backboard and share a common return mechanism. A number of players may thus efficiently practice at the same time by using a center constructed in accordance with the present invention, with the players rotating positions periodically, or remaining in continuous motion, as desired.

The pivotal positionability of the ball racks included in shooting and return centers constructed in accordance with the present invention enables players to selectively position individual ball racks to return balls at locations an appropriate distance from the baskets for the practice of jump shots, free throws, or a combination of movements and jump shots. Adjacent ball racks can be positioned at different angular orientations to return balls at desired remote locations, enabling players to periodically rotate through the various positions corresponding to the ball racks to practice a wide variety of types of shots.

In a further aspect of the present invention, the ball return table of the shooting center folds upwardly against the backboard structure to enable the center to be stored out of the way, thus freeing up floor space beneath the center in between practice sessions. The ball return table and backboard structure can also be suspended from the ceiling, and then raised upwardly to further free up the floor space underneath. A center constructed in accordance with the present invention can thus be installed over a gymnasium floor without obstructing the floor in between practice sessions. Alternatively, the center can be installed over "wasted space" areas of gymnasiums where shooting practice would otherwise not be possible, thereby increasing the utilizable space in a gym or other facility. For example, a suspended shooting and return center constructed in accordance with the present invention can be installed over a stairwell or stage.

Finally, in a further aspect of the present invention, the basketball shooting and return center constructed in accordance with the present invention can be mounted on a portable base, such as a trailer, enabling one or more basketball shooting and return centers to be positioned within a facility during practice times and then removed from the facility after practice, as may be desirable for use by professional basketball teams.

BRIEF DESCRIPTION OF THE DRAWINGS

The present invention will be better understood by those of ordinary skill in view of the following detailed description and the appended drawings, in which.

DETAILED DESCRIPTION OF THE PREFERRED EMBODIMENT

Figure 1:
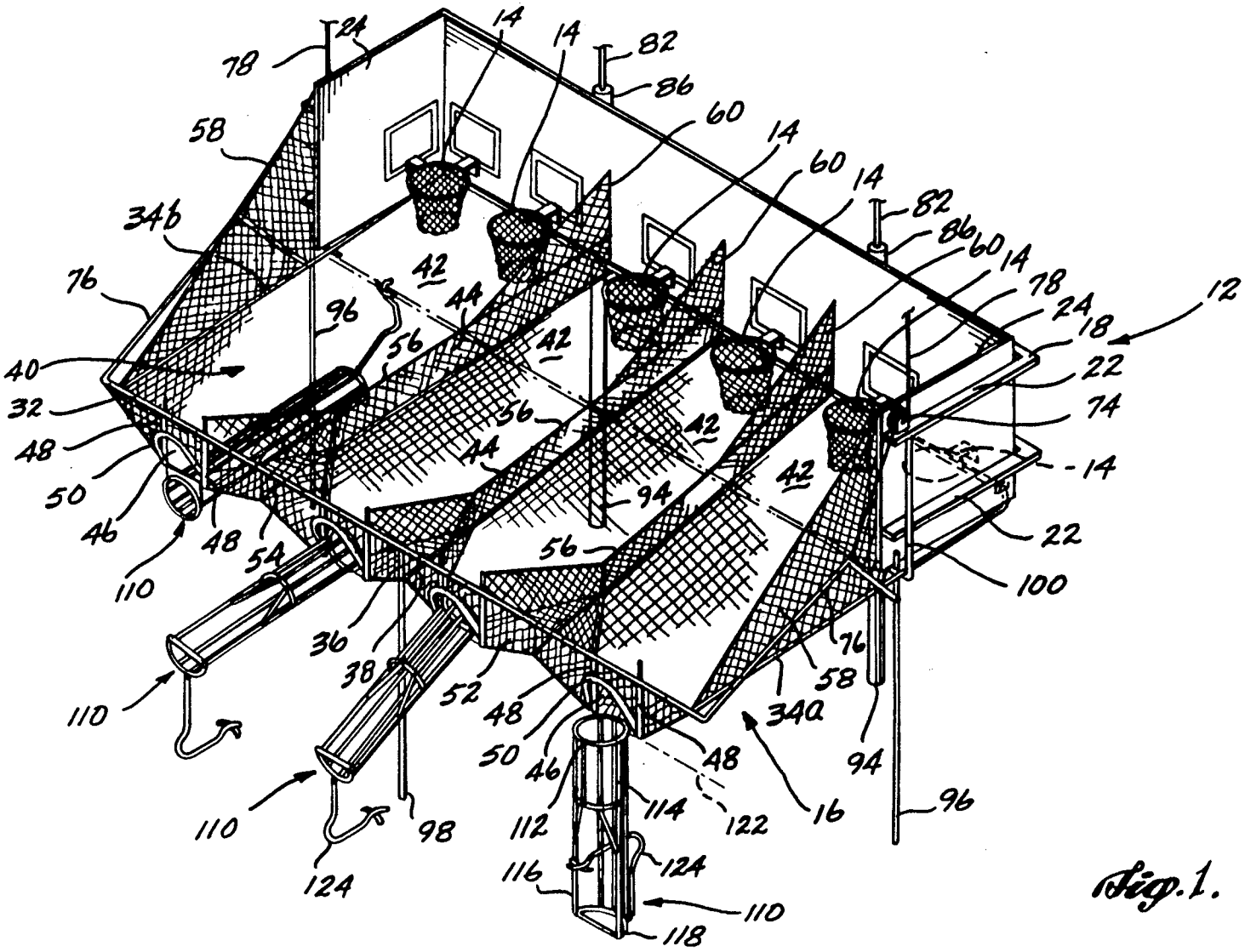
FIG. 1 is a pictorial view of a suspended basketball shooting and return center constructed in accordance with the present invention, with the ceiling support structure from which the center is suspended removed for clarity.

A first preferred embodiment of a basketball shooting and return center 10 constructed in accordance with the present invention is shown in FIG. 1. The center 10 includes an integral backboard structure 12 on which are mounted a plurality of spaced-apart baskets 14. A ball return table 16 is pivotally mounted to the backboard structure 12 beneath the baskets 14. The ball return table 16 is of unitary construction and serves to return balls from each of the baskets 14 to corresponding discharge points. Balls shot at the baskets 14 by a player standing in front of the ball return table 16 are captured by the ball return table 16 and returned to the player at locations remote from the baskets 14.

Figure 2:
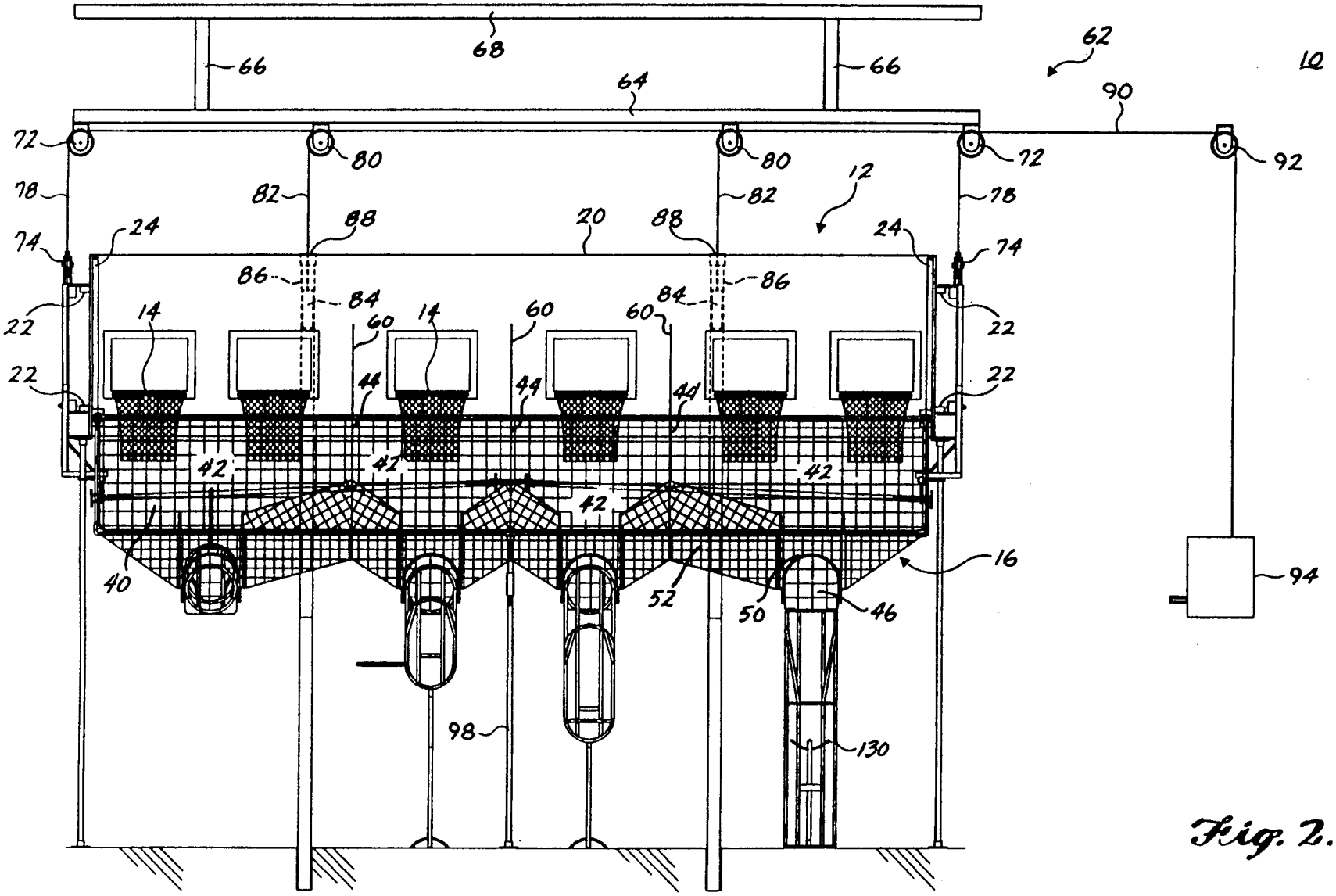
FIG. 2 is a front elevation view of the basketball shooting and return center of FIG. 1, including the ceiling support structure, cable, and winch suspension mechanism.
Figure 3:
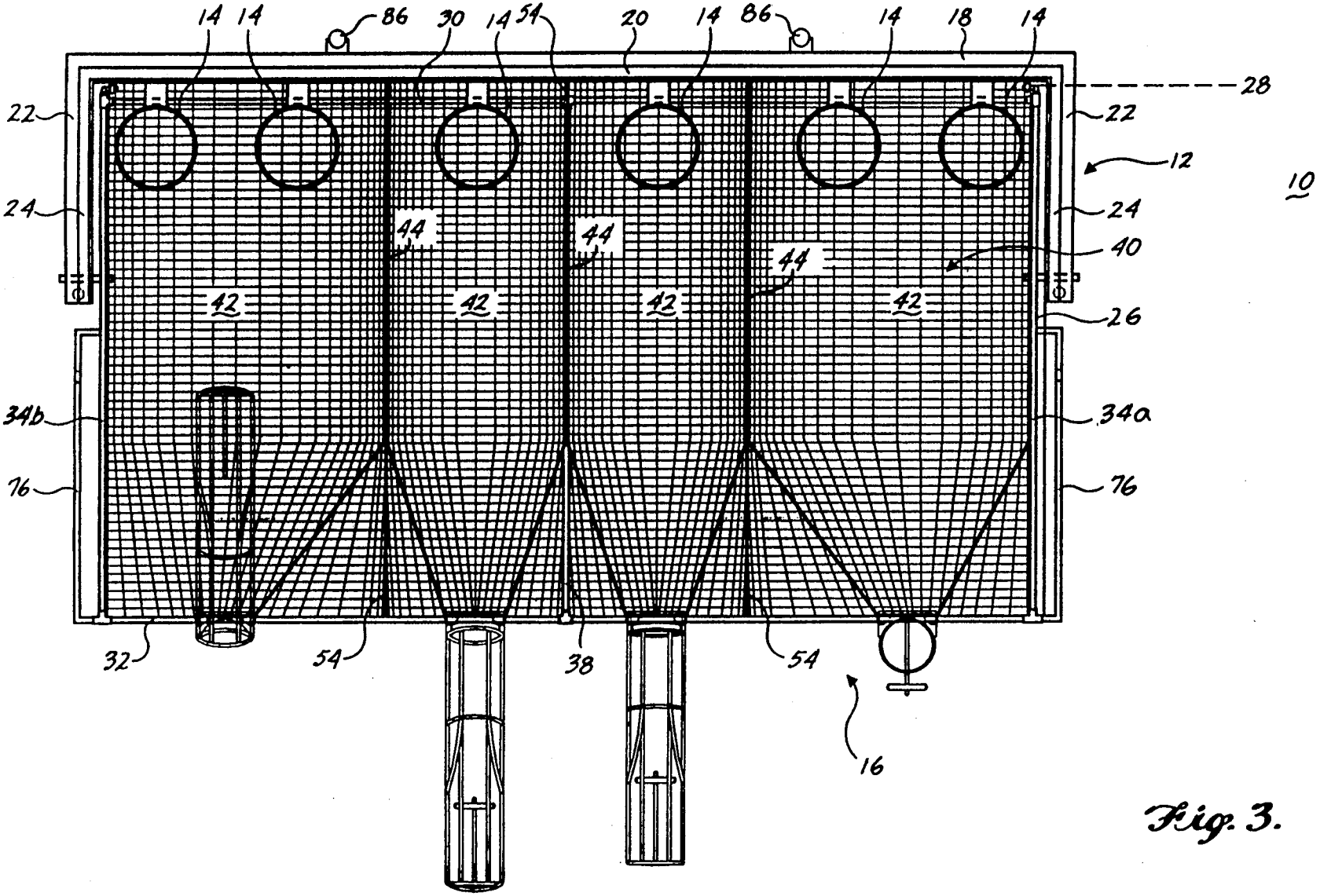
FIG. 3 is a top plan view of the basketball shooting and return center of FIG. 1.

Referring to FIGS. 1 through 3, the backboard structure 12 includes two vertically spaced, parallel, horizontal elongate frame members 18. A single unitary elongate backboard 20, which may be constructed from wood, thermoplastic, glass, or other rigid material, is secured to the forward side of the elongate frame members 18, which serve to stiffen the backboard 20. The ends of each frame member 18 terminate in a 90° forwardly projecting side extension member 22. As used herein throughout, the term "forward" refers to the direction away from the backboard and towards a player, while the term "rearward" refers to the converse direction.

When viewed from above, as in FIG. 3, the frame members 18 and side extension members 22 define an elongate C shape. A sideboard 24 is mounted on the inside of each spaced pair of side extension members 22, such that the backboard 20 and sideboards 24 also define a generally elongate C-shaped configuration when viewed from above. The sideboards enable players to shoot at the closest corresponding basket by aiming at either the backboard 20 or sideboard 24, increasing the range of shooting angle conditions available to the player.

A plurality of baskets 14 are secured periodically in spaced-apart relationship along the length of the backboard 20. Although a total of six baskets 14 are shown in the illustrated preferred embodiment of a center 10, other quantities of baskets 14, such as three, four, or five baskets, can be utilized. Also, if desired, additional baskets 14 could be mounted on the inside of each of the sideboards 24. As with conventional baskets, the baskets 14 serve as goals for a player to attempt to throw a basket through.

Reference is now had to FIGS. 1 and 3 to describe construction of the ball return table 16. The ball return table 16 includes a peripheral, rectangular table frame 26 constructed from a rigid material, such as tubular steel. The rearward corners of the frame 26 are pivotally secured to the backboard 20 so that the frame 26 pivots about a table pivot axis 28. The table frame 26 includes an elongate rear member 30, front member 32, and side members 34*a* and 34*b*. A short frame extension member 36 projects downwardly from the center of the front frame member 32. A central frame member 38 extends rearwardly from the bottom of the frame extension member 36 to the center of the rear frame member 30 to strengthen the frame 26.

A contoured sheet of flexible, resilient webbing, such as netting 40, spans the table frame 26 and is secured about its edges to the rear frame member 30, front frame member 32, and side frame members 34*a* and 34*b*. The netting 40 is contoured and configured to form a plurality of integrated but distinct ball return troughs 42. Each trough is associated with at least one basket 14.

Figure 4:
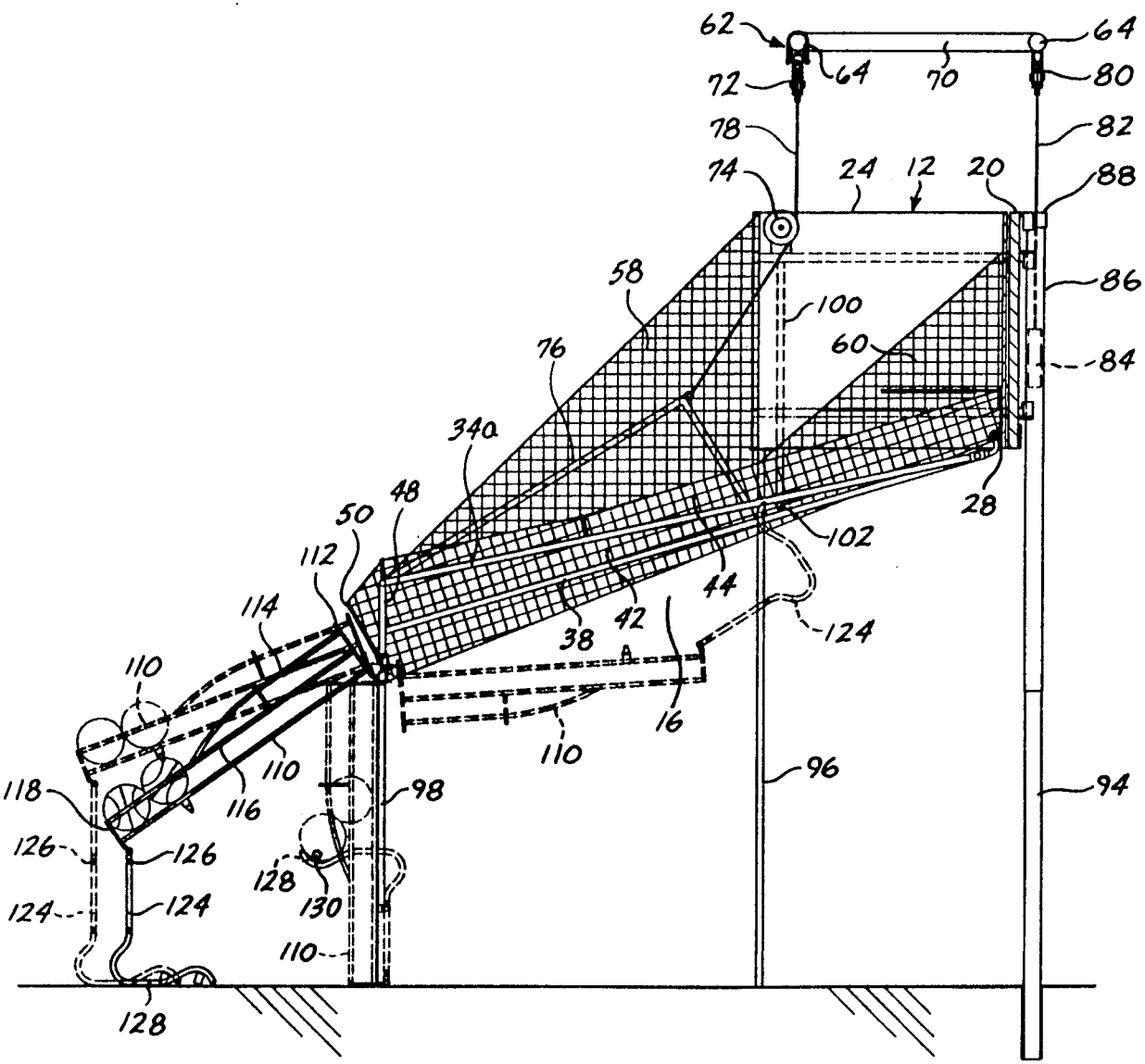
FIG. 4 is a side elevation view of the basketball shooting and return center of FIG. 1, with one sideboard of the backboard structure and a net sidewall extension removed for clarity, with a ball rack shown in the intermediate position, and also shown in phantom in the elevated, vertical, and storage positions.

Referring to FIGS. 1 through 4, the preferred embodiment of a center 10 is illustrated as including four adjacent ball return troughs 42. The ball return troughs 42 are disposed parallel to each other, and are separated by upwardly projecting sidewalls 44. Each of the troughs 42 slopes downwardly and forwardly from the backboard 20, as shown in FIG. 4. Each trough 42 further is contoured to slope towards its center, as shown in FIG. 2, so that balls captured within the trough 42 are funnelled downwardly and centrally to an exit opening 46.

The exit opening 46 of each trough 42 is defined in part by a pair of spaced apart net standoff rods 48 projecting downwardly from the front frame member 32. Each pair of net standoff rods is disposed on either side of the approximate center of the associated trough 42. The netting 40 is secured to the bottom ends of the net standoff rods 48 so as to introduce a centrally and downwardly sloping contour to the troughs 42. Each exit opening 46 is further framed by an upside down U-shaped collar member 50 having downwardly extending ends secured to the lower ends of the net standoff rods 48. The netting 40 is secured about the collars 50 and thus defines a vertical front face portion 52 of the netting 40. An opening is formed thru the netting 40 at each location circumscribed by a collar 50 so as to allow passage of returned balls through the corresponding exit opening 46.

Referring to FIGS. 1 and 3, the boundary between adjacent troughs 42 is defined in part by bottom cables 54 extending from the rear frame member 30 forwardly to a point approaching the front fame member 32 between adjacent pairs of net standoff rods 48. The forward end of each bottom cable 54 then forms a "T", with each branch of the "T" being secured to the bottom end of the closest adjacent net standoff rod 48. The netting 40 is secured to each the bottom cables 54 so as to raise the netting 40 between troughs 42.

A top cable 56 overlies each bottom cable 54, but are spaced upwardly above the netting 40. Each top cable 56 extends forwardly from the rear frame member 30 towards the front frame member 36. Before reaching the front frame member 36, each top cable 56 forms a "T", with each side of the "T" being secured to an upwardly extending portion of a net offset rod 48. An upwardly extending web of netting is secured between each bottom cable 54 and overlying parallel top cable 56 to form an upwardly projecting sidewall 44. The net sidewalls 44 serve to provide greater depth to the ball return troughs 42, and to separate adjacent troughs 42.

Referring to FIG. 1, the ball return table 16 further includes first and second net end walls 58 projecting upwardly from each forward corner of the frame 26 to the upward forward corner of the corresponding sideboard 24 of the backboard structure 12, so as to define the sides of the outermost troughs 42. The intermediate sidewalls 44 each also include an upwardly projecting angled net extension 60 between adjacent baskets 14 to prevent rebounds from baskets associated with a particular trough 42 from entering into the next trough 42.

Referring still to FIGS. 1 and 3, the preferred embodiment of the center 10 shown includes two narrow center troughs 42, each corresponding to a single basket 14, and two wider end troughs 42, each corresponding to two adjacent baskets 14. The exact number of baskets associated with each trough 42 may be adjusted depending on the number of shooting positions desired for a particular center 10.

Reference is now had to FIGS. 1, 2, 4, and 5 to describe the support mechanism for the backboard structure 12 and the ball return table 16. The backboard structure 12 and ball return table 16 are supported both from above by a cable suspension mechanism and from below by a plurality of detachable or foldable support legs. Reference is initially had to FIGS. 1, 2, and 4 to describe the cable suspension of the center 10. The backboard structure 12 and ball return table 16 are suspended from a ceiling mounted overhead support structure 62 having first and second parallel elongate members 64, spaced apart and disposed parallel to the backboard 20. The elongate members 64 are mounted on struts 66 extending downwardly from a ceiling beam 68 (FIG. 2). The elongate members 64 are strengthened and maintained spaced apart by transverse support members 70 (FIG. 4). Together, the members 64, 66, and 70, and the ceiling beam 68 provides a rigid support structure.

Two first pulleys 72 are mounted on swivels, and depend downwardly from, the ends of the forwardmost elongate overhead member 64. Corresponding second pulleys 74 are mounted on the forward ends of the upper side extension members 22 of the backboard structure 12, below the first pulleys 72, as shown in FIGS. 2 and 4.

Referring to FIGS. 1, 3 and 4, the table frame 26 of the ball return table 16 includes a generally triangular brace 76 secured to, and projecting outwardly from, the forward portion of each side frame member 34*a* and 34*b*. Referring to FIGS. 1, 2, and 4, a first suspension cable 78 is secured to each side of the ball return table 16. Each first suspension cable 78 has a lower end secured to the upper corner of a corresponding triangular brace 76 of the ball return table 16. The cable 78 then engages with the underside of the corresponding second pulley 74 on the backboard structure 12, and is then trained over the top side of the first pulley 72 on the overhead support structure 62.

Referring to FIGS. 1, 2, and 4, two third pulleys 80 are swivelably secured to the rear transverse member 70 of the overhead support structure 62. The third pulleys 80 are inset centrally relative the first pulleys 72. Each of a pair of second suspension cables 82 has a first end secured to a weight 84 that is slidably secured within a corresponding vertical elongate tube 86 attached across the rear side of the frame members 18 of the backboard structure 12. Each elongate tube 86 is capped by a cap 88 having a central aperture therein. The corresponding second suspension cable 82 slides thru the central aperture of the tube cap 88, but the weight 84 is larger than the central aperture and is this prevented from withdrawing from the tube 86. After passing through the caps 88 of the tubes 86, the second suspension cables 82 each are trained over a corresponding third pulley 80 on the overhead support structure 62.

Referring to FIG. 2, the two first suspension cables 78 and the two second suspension cables 82 are each trained over their corresponding pulleys 72 and 80 toward one side of the overhead support structure 62. The first and second suspension cables 78 and 82 are then joined to a common collection cable 90, which is trained over a collection pulley 92, secured either to a ceiling beam (not shown) or a wall structure (not shown). After passing over the collection pulley 92, the collection cable 90 is engaged with a conventional winch 94 that is operable to either wind up, or release in a controlled fashion, the first and second suspension cables 78 and 82. The first and second suspension cables 78 and 82 and winch 94 are used to raise and lower the backboard structure 12 and ball return table 16 between a raised storage position and a lowered in-use position, as shall be described subsequently.

Figure 5:
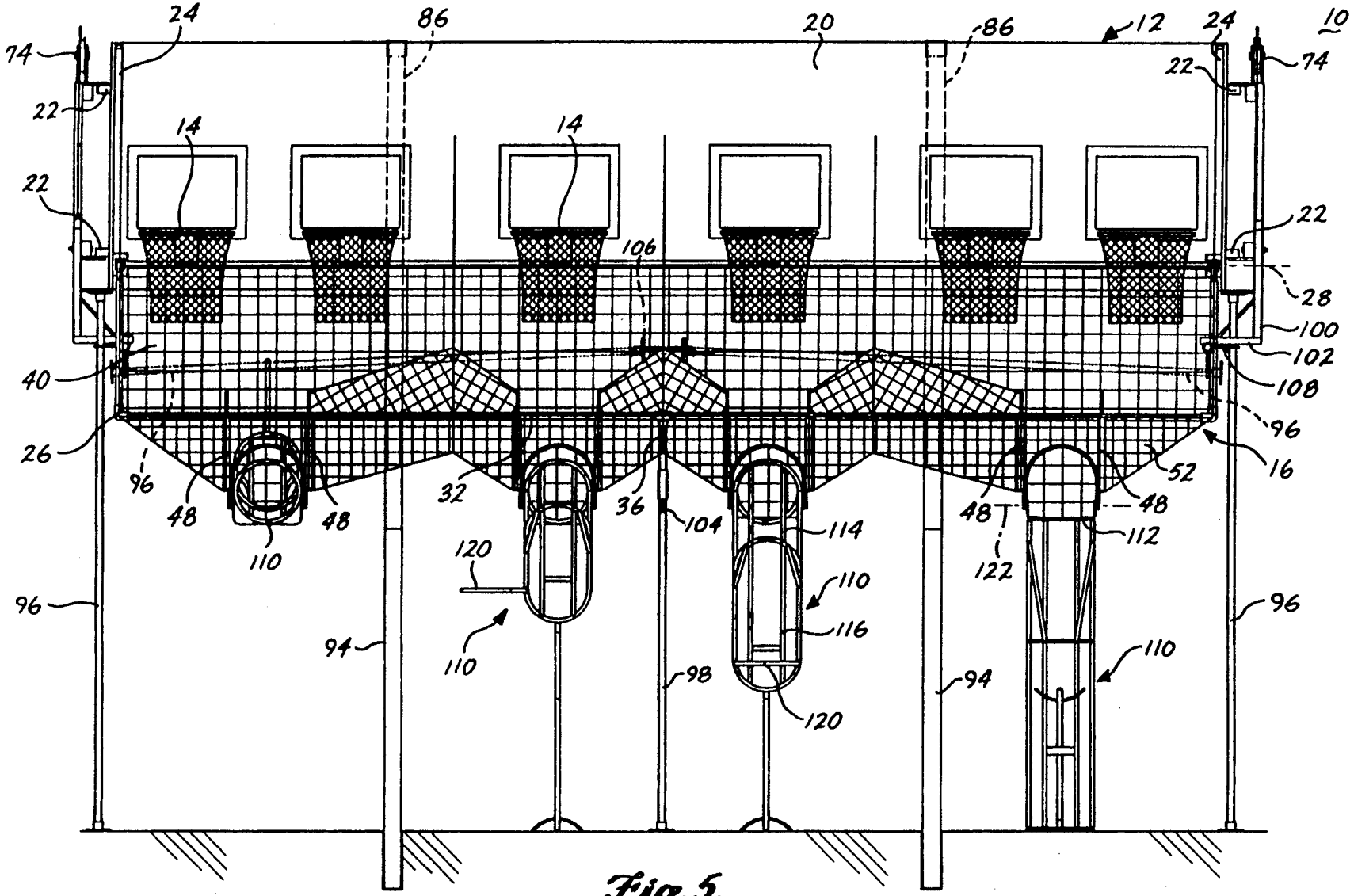
FIG. 5 is an enlarged front elevation view of the basketball shooting and return center as shown in FIG. 2, with the overhead ceiling structure removed for clarity.

Reference is now had to FIGS. 1, 4, and 5 to describe the support of the backboard structure 12 and ball return table 16 when the center 10 is in its lowered in-use position. The weight of the backboard structure 12 is primarily supported by two upright stanchions 94. The upper ends of the stanchions 94 are received in the lower ends of the elongate tubes 86, which as noted above are secured to the rear side of the frame members 18 of the backboard structure 12. The lower ends of the stanchions 94 are received in receptacles embedded in the floor of the gymnasium or other facility in which the center 10 is installed. The backboard structure 12 is further supported by a pair of side leg supports 96. Each side leg support 96 depends downwardly from the underside of the forward edge of a corresponding sideboard 24.

The forward weight of the ball return table 16 is supported by a center leg support 98, pivotably secured by a knuckle joint to the underside of the central frame extension member 36 that depends downwardly from the center of the front frame member 32 of the ball return table frame 26. The side leg supports 96 and center leg support 98 are each foldable under the ball return table 16 for storage in a manner which shall be described subsequently.

The ball return table 16 is further supported by a pair of table support arms 100 that depend from the backboard structure 12. The support arms 100 are secured across the outside of the forward ends of the side extension members 22 of the backboard structure 12. The support arms 100 each depend downwardly from the backboard structure 12, and terminate in a 90° angled support bar 102 that projects under the ball return table 16. When the ball return table 16 is lowered to its in-use position, the side frame members **34*a* and 34*b* rest on the support bar portions 102 of the table support arms 100, thereby assuring a positive downward stop to prevent further pivotal motion of the ball return table 16**.

In use, the backboard structure 12 and ball return table 16 are supported by the rear stanchions 94, side leg supports 96, and center leg support 98. However, when the center 10 is not in use, the backboard structure 12 and ball return table 16 can be raised upwardly, free of the supporting floor surface, to permit other uses of the floor area. Referring to FIGS. 2 and 4, the backboard structure 12 and ball return table 16 are raised from the lowered in-use position to the storage position by operating the winch 94 to draw the first and second suspension cables 78 and 82 upwardly.

Referring to FIG. 4, as the cable 78 is drawn upwardly, the ball return table 16 pivots upwardly about the table pivot axis 28 as the triangular braces 76 of the ball return table 16 are drawn towards the second pulleys 74. Concurrently, the drawing of the second suspension cables 82 causes the weights 84 within the elongate tubes 86 to raise until they contact the overlying caps 88.

Figure 6:
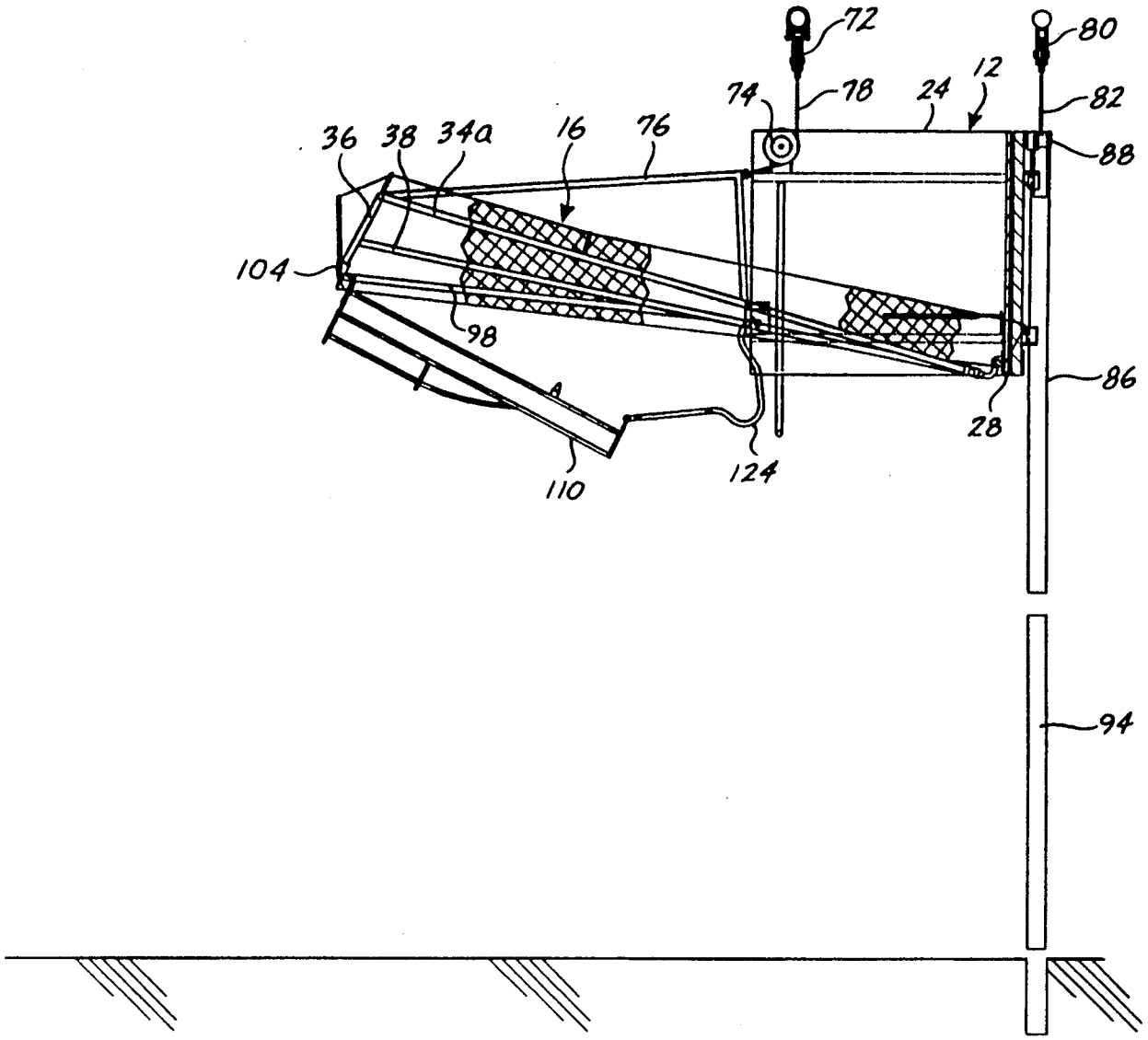
FIG. 6 is a side elevation view of the basketball shooting and return center as shown in FIG. 4, but with a ball rack shown in the storage position, the ball return table shown folded and raised upwardly for storage, and with only portions of the ball return table netting shown for clarity.

Referring to FIG. 6, once the triangular braces 76 have been raised in proximity to the second pulley 74, and the weights 84 contact the caps 88 of the elongate tubes 86, the entire backboard structure 12 and ball return table 16 are raised upwardly as the first suspension cables 78 and second suspension cables 82 are further drawn upward. In this position, the ball return table 16 is folded to slope upwardly from the backboard 20, keeping the table 16 out of the way of players passing underneath the raised center 10. As the elongate tubes 86 are raised together with the backboard structure 12, they separate from the corresponding stanchions 94, which can then be removed from their receptacles within the floor if so desired.

Referring to FIGS. 2 and 6, the side leg supports 96 and center leg support 98 can each be folded under the ball return table 16, to lie substantially parallel to the ball return table 16, prior to or during the raising of the backboard structure 12 and ball return table 16 to the upper storage position. This permits free passage of people under the stored center 10. The center leg 98 pivots on a knuckle 104 (FIG. 5) for folding. Once folded underneath the table 16 (FIG. 6), the center support leg 98 is retained in the folded configuration by a hook (not shown) depending downwardly from the central frame member 38.

The side support legs 96 also fold upwardly, with the lower ends of the legs being received by hooks 106 secured to the central frame member 38 of the ball return table 16, as shown in phantom in FIG. 5. To enable folding in this manner, the side leg supports 96 pass through a pivot ring 108, pivotably secured to the underside of a corresponding support bar 102. The side support leg 96 slides through the pivot ring 108 as the leg 96 is folded. The rings 108 also serves to position the side legs 96 when the side legs are folded downwardly to support the backboard structure 12 in the lowered in-use position.

Reference is now had to FIGS. 1–5 to describe a further significant aspect of the present invention. The basketball shooting and return center 10 includes an elongate ball rack 110 secured to the ball return table 16 adjacent each exit opening 46 for directing returned balls to a player at a point remote from the ball return table 16. Thus preferably the center 10 includes one ball rack 110 for each ball return trough 42. Each ball rack 110 has an elongate, generally tubular construction, and is constructed from a skeleton of parallel elongate members secured within transverse circular and semicircular reinforcing members.

Referring to FIGS. 1 and 5, a first end 112 of each ball rack 110 is pivotally secured to the ends of a corresponding pair of net stand-off rods 48, which depend downwardly from the front frame member 32 of the ball return table frame 26 on either side of the trough exit opening 46. The diameter of the first end 112 of the ball rack 110 is slightly smaller than the collar 50 surrounding the corresponding exit opening 46. Each ball rack 110 includes a tubular portion 114 adjacent the first end 112 and a partially tubular portion 116 adjacent the distal, remote end 118 of the ball rack 110. The upper portion of the partially tubular portion 116 of the ball rack 110 is missing, so that the partially tubular portion 116 forms a concave trough.

A transverse member 120 is secured across the remote end 118 of each ball rack 110. The transverse member 120 is pivotable between a closed position, wherein it prevents balls from exiting the ball rack 110 (FIG. 4), and an open position in which balls are free to pass through the ball rack 110 (FIG. 5). When balls are captured in a ball return trough 42, they are funnelled downwardly to the exit opening 46 of the trough. The returned balls are then received within the corresponding ball rack 110, whereupon they are funnelled to the remote end 118 of the ball rack 110 for delivery or presentation to the player at a selected position remote from the table 16.

Referring to FIGS. 1 and 4, the ball racks 110 are each pivotable about a pivot axis 122 corresponding to the point of pivotal attachment to the ball return table frame 26. The angular orientation of the ball rack 110 relative to the ball return table 16 determines the distance from the ball return table 16 at which the ball is returned to a player, and thus also determines the type of shooting practice experienced by the player at that position.

Each ball rack 110 is maintained in a selected angular position by adjustment of a support arm 124. Referring to FIGS. 1 and 4, a support arm 124 is pivotally attached at a first end to the lower side of the remote end 118 of each ball rack 110. A first portion of the support arm 124 telescopes at a joint 126 to change the length of the support arm 124. A second terminal portion 128 of the support arm 124 is bent or otherwise formed at a generally right angle relative to the first portion.

When the support arm 124 is increased to its maximum length and is pivoted to depend downwardly from the remote end 118 of the ball rack 110, the ball rack 110 is positioned in its highest orientation and returns balls to a user at the furthest remote point from the ball return table 16. When in this position, the transverse member 120 of the ball rack 110 can be opened, as shown in FIG. 2, to enable balls received from the ball rack 110 to be discharged to a waiting player from the remote end 118 of the ball rack for the practice of bounce passes.

Referring again to FIGS. 1 and 4, when the support arm 124 is telescoped to a shorter length but still depends downwardly from the remote end 118 of the ball rack 110, the ball rack 110 is oriented in an intermediate elevated position, appropriate for practicing free-throws at a location relative to the baskets 14 corresponding to the free-throw line.

Referring to FIGS. 1, 2 and 4, the ball rack 110 is also positionable in a downwardly projecting vertical orientation, in which the support arm 124 is pivoted so that the terminal portion 128 of the support arm is folded upwardly and projects through and into the partial tubular portion 116 of the ball rack 110. The distal end of the terminal portion 128 of the ball rack 110 is curved so as to form an upwardly opening arcuate ball rest when in this position. An upwardly arcuate cross piece 130 is secured across the end of the terminal portion 128 of the support arm 124 to complete the ball rest. The terminal portion 128 of the support arm 124 is pivoted about the joint 126 during insertion of the terminal portion 128 into the ball rack 110 for placement of the ball rack 110 in this vertical position.

When in the vertical orientation, balls entering the ball rack 110 are retained stacked within the tubular portion 114 of the rack by the terminal portion 128 of the support arm 124, as shown in phantom in FIG. 4. The stacked balls are thus individually presented to players for practicing jump shots. In this vertical position, the area immediately in front of the return table 16 is opened up for lateral movement, i.e., the ball rack 110 is out of the way of the player, permitting him or her to move laterally relative to each basket 14 as desired. As shown in FIG. 4, the terminal portion 128 of the support arm 124 serves to support the ball rack 110 when the ball rack is elevated to the intermediate and highest positions, and also serves as a ball retention device when the ball rack 110 is in the vertical position.

Finally, referring to FIGS. 1, 4, 5 and 6, the ball rack 110 is pivotable to a storage position, in which the ball rack is folded upwardly under the ball return table 16 so that it is out of the way of people passing underneath the raised center 10. In the stored position, the terminal portion 128 of the support arm 124 of each ball rack 110 hooks onto a folded side support leg 96 (FIG. 5) to retain the ball racks 110 in position.

Reference is now had generally to FIG. 1 to describe use of the center 10 when in the lowered in-use position. The center 10 may be used by an individual player, but is ideally suited to accommodate use by a number of players. The ball racks 110 may all be positioned in the same configuration or in different configurations, depending on the type of shooting practice desired. For example, all the ball racks 110 may be positioned vertically to permit lateral movement close to the ball return table 16 for a number of players to practice jump shots. Alternately, different ball racks 110 can be positioned in the vertical, intermediate, and highest positions, or other positions therebetween. Multiple players would then periodically rotate from rack to rack to practice a full variety of shots.

When a player stands in front of or next to a particular ball rack 110, he or she is able, from that stationary position, to shoot at any one of the baskets 14. Each basket is located a different distance from the player, and is at a different angle relative to the player. Thus, without moving laterally to change position, the player can shoot at different baskets to practice shooting from different locations on a basketball court. When multiple players use the center 10, shooting at differing baskets can be orchestrated to ensure that each player can shoot at a variety of baskets while receiving a continuous supply of returned balls from the individual ball rack 110 by which the player is positioned. Also, as the balls are returned to the player by the ball return table 16, the player need not move toward and away from the table 16.

Figure 7:
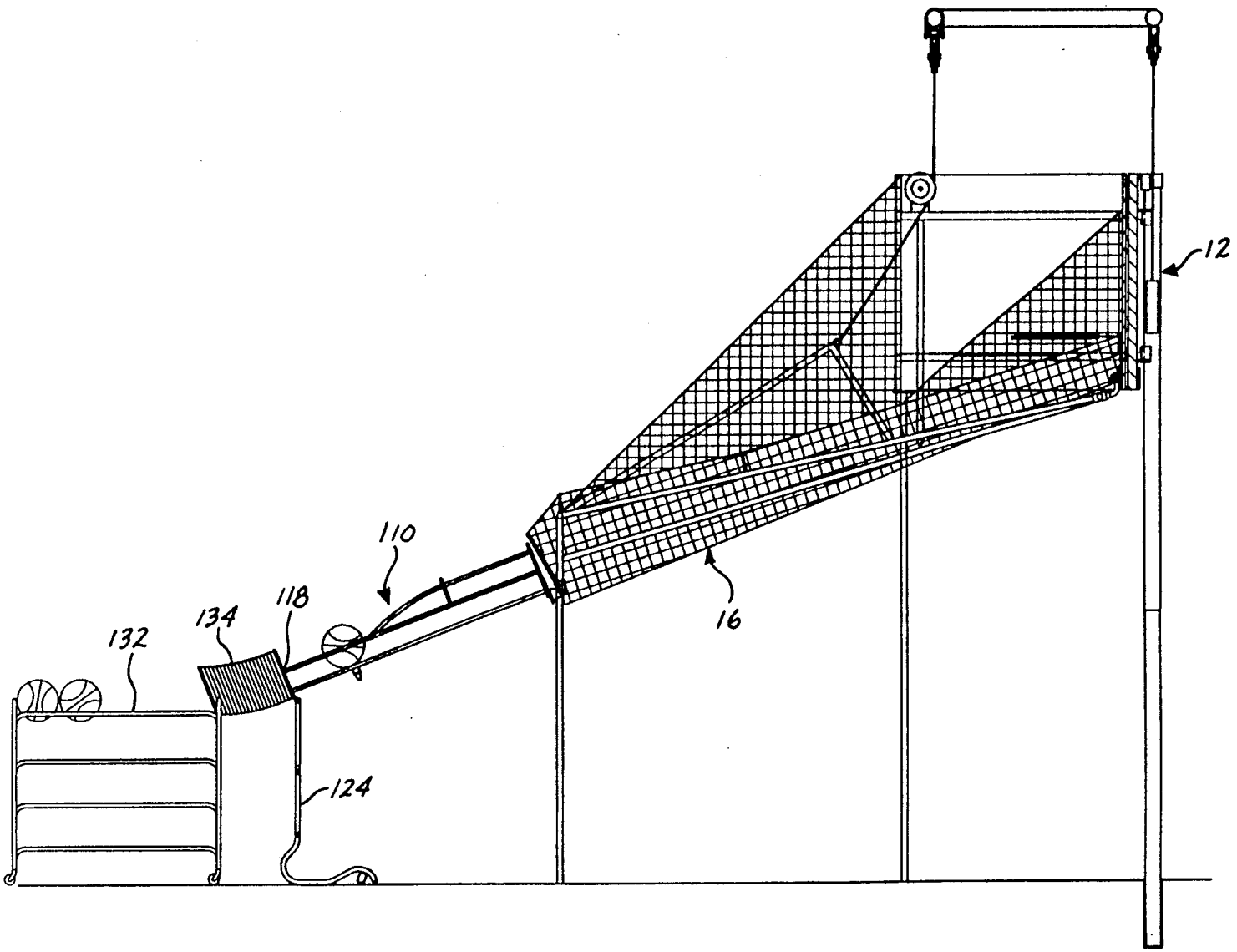
FIG. 7 is a side elevation view of the basketball shooting and return center as shown in FIG. 4, but with the addition of a flexible conduit extending from the remote end of a ball rack to a floor engaging extension rack.

A further aspect of the present invention is shown in FIG. 7. If a player desires to receive balls at a position located further from the ball return table 16 than would otherwise be possible, an extension rack 132 may be utilized. The extension rack 132 shown is a conventional elongate caster mounted ball storage rack. A length of flexible duct 134, such as a spiral wire reinforced tubular plastic duct, is connected between a ball rack 110 and the extension rack 132. A first end of the duct 134 is secured about the remote end 118 of the ball rack 110, with the transverse member 120 on the remote end 118 in the open position. The opposite end of the duct 134 is secured adjacent the top tier of the extension rack 132.

Balls passing thru the ball rack 110 thus are funnelled onto the extension rack 132 to await pick up by a player. The flexible nature of the duct 134 enables the extension rack 132 to be positioned at an angle relative to the ball rack 110, thus affording the player a broader range of shooting positions to which balls will be returned. It should also be apparent that a "Y" shaped duct (not shown) could be similarly used to connect two ball racks 110 to a single extension rack 132.

Figure 8:
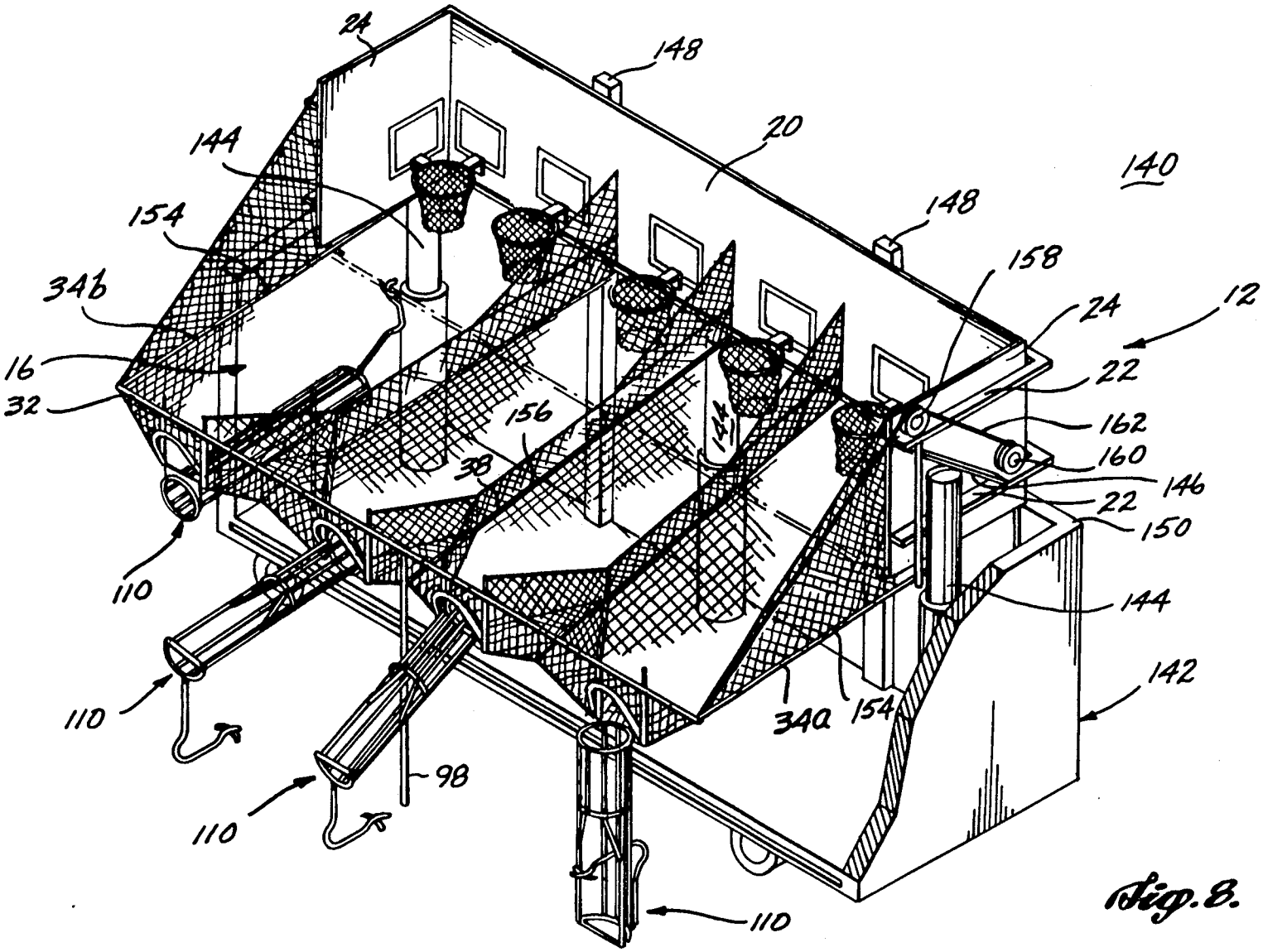
FIG. 8 is a pictorial view of an alternate portable trailer mounted embodiment of a basketball shooting and return center constructed in accordance with the present invention.

An alternate embodiment of a portable basketball shooting and return center 140 is shown in FIGS. 8 and 9. The portable center 140 is identical to the previously described center 10, with several exceptions noted below. To avoid repetition, features of the portable center 140 that are identical to corresponding features of the center 10 are referred to using the same reference numerals, and are not described in detail.

The portable center 140 includes a backboard structure 12, a ball return table 16, and ball racks 110, as described previously in relation to the center 10. However, rather than being suspended from the ceiling, the center 140 is mounted on a portable base, such as the wheeled trailer 142 shown in FIG. 8. The top and front side (not shown) of the trailer open to expose the center 140 for use. The top and front side may be hinged or may comprise a corrugated roller-mounted closure.

The portable center 140 is shown in FIG. 8 in the in-use configuration. The front edge of the ball return table is supported by a foldable center leg, as previously described. However, rather than being supported by the stanchions and side legs previously described, the backboard structure 12 is supported by three hydraulic lifts 144. First and second hydraulic lifts support the sides of the backboard structure 12, while a third lift 144 supports the center of the backboard structure 12.

Figure 9C:
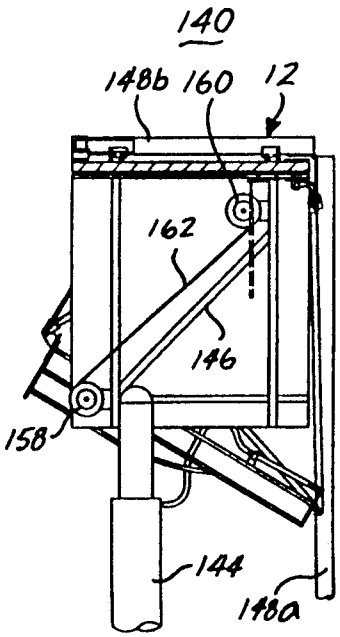
FIGS. 9A, 9B and 9C are sequential side elevation views of the embodiment of FIG. 8, with the ball return table and backboard structure shown being folded for storage.
Figure 9B:
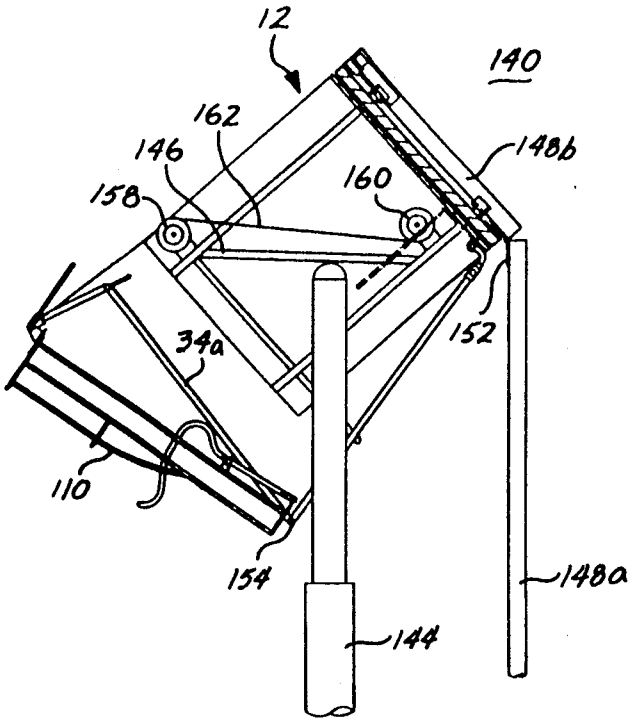
Figure 9A:
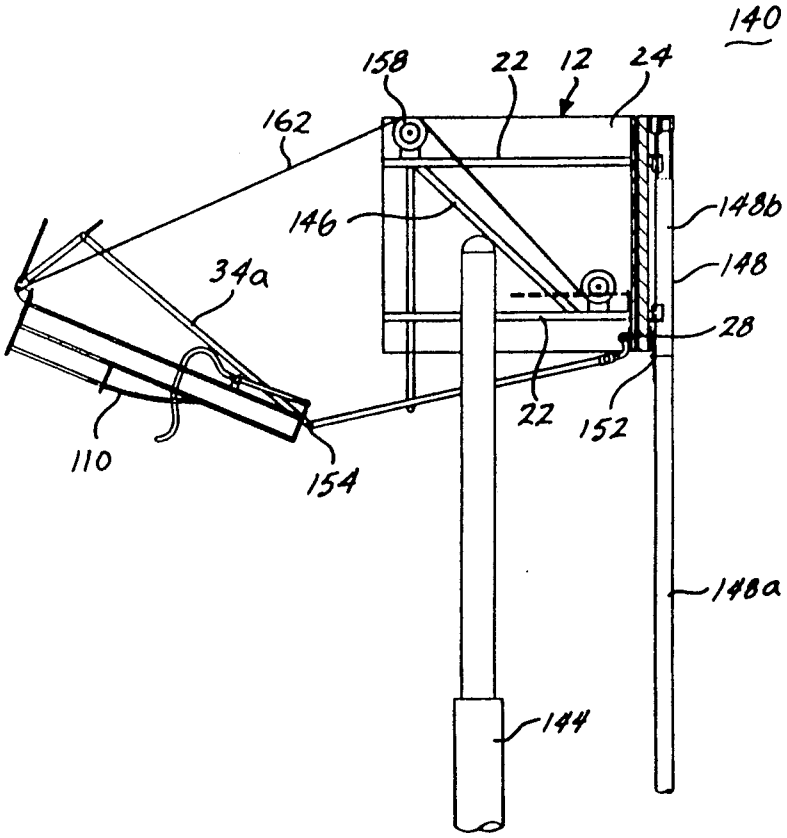

Referring to FIGS. 8 and 9A, the backboard structure 12 includes a diagonal brace 146 secured across the side extension members 22 behind each sideboard 24. The diagonal brace 146 extends from the rear end of the lower side extension frame member 22 to the forward end of the upper side extension frame member 22. The ram of each of the first and second hydraulic lifts 144 contacts the underside of a corresponding brace 146. The top of the rams of the first and second lifts 144 are arcuately contoured.

Referring still to FIGS. 8 and 9A, two spaced apart vertical struts 148 are secured between the backboard structure 12 and the rear wall 150 of the trailer. Each strut 148 comprises a hinged rectangular-sectioned tube or other structural member. The lower portion **148*a* of the strut is secured to the rear wall 150, and is joined to the upper portion 148*b* of the strut by a hinge 152. The lower portion 148*a* telescopes to allow the entire backboard structure 12 to be lowered into, and raised from, the trailer 142. The backboard structure 12 is secured to the forward face of the upper portion 148*b*** of the strut.

Referring to FIGS. 9A thru 9C, the backboard structure can be folded down into the trailer 142 by lowering the rams of the first and second side lifts 144. As the rams are lowered, the diagonal brace 146 of the backboard structure 12 rides along the arcuate top of the rams of the lifts 144, the struts 148 fold at the hinges 152, and the backboard structure 12 folds downwardly. In the fully folded position, as shown in FIG. 9C, the backboard structure 12 is rotated downwardly a full ninety degrees. The rams of the lifts 144 are then further lowered to lower the folded backboard structure 12 and table 16 into the trailer 142.

Along with rotation of the backboard, the ball return table 16 folds and collapses within the trailer 142. The ball return table 16 pivots relative to the backboard structure 16 on a pivot axis 28, as described previously. However, the side members **34*a* and 34*b* of the table frame also each include a pivot joint 154, and the central frame member 38 includes a double pivot joint 156, so that the ball return table is capable of folding upwardly upon itself, as shown in FIGS. 9A through 9C**.

In order to fold the ball return table 16, the backboard structure 16 includes on each side an upper pulley 158 mounted on the upper side extension frame member 22, proximate the upper end of the brace 146, and a lower pulley 160, mounted on the lower side extension frame member 22 proximate the lower end of the brace 146. A cable 162 has a first end secured to a the front table frame member 32 of the table 16, passes over the upper pulley 158, passes under the lower pulley 160, and has a second end engaged with a trailer mounted winch (not shown). The winch is operated to collapse the ball return table 16 into the trailer 142 by drawing on the cable 162 as the backboard structure 12 is lowered into the trailer 142. As shown in FIG. 9C, the collapsed center 140 has a compact envelope, so that it can be stored completely within the trailer 142 for storage and transport.

Although the present invention has been described by way of several preferred embodiments of shooting and return centers 10 and 140, it should be apparent to those skilled in the art that various modifications can be made within the scope of the present invention. For example, rather than using netting on the ball return table 16, other flexible, resilient material such as a heavy gage plastic sheeting could be used.

The centers 10 and 140 have been illustrated and described as including a plurality of separate ball return troughs 42 and corresponding ball racks 110. However, it should be evident that a shooting and return center could be constructed in accordance with the present invention to include a single ball return trough common to all of the baskets 14, and a single corresponding discharge ball rack 110. Although the ball racks 110 have been described as being formed from a number of elongate members secured together by hoops, it should be apparent that other constructions are possible, such as a solid walled tubular conduit or an open concave trough. However, the partial tubular construction described above in relation to the preferred embodiments is preferably to facilitate use of the tubes in various angular orientations, including vertical. It should also be apparent that the ball racks 110 could be constructed to telescope to enable varying the lengths of the racks 110 as well as their angular orientations.

As a further example of a modification, the center 10 described above could be mounted on a wall by securing the backboard structure directly to the wall, rather than suspending the center. However, this arrangement has been found to not be as preferable as the suspended configuration, since the wall may require reinforcement to support the moment of the center, and the space below the center can not be freed up as completely as with the suspended version.

Finally, a center 10 or 140 can be constructed as described previously to include circuitry and sensors mounted in the baskets 14 to monitor the number of baskets made, as well as sensors mounted in the troughs to monitor the number of baskets attempted. This data can be displayed on an electronic display or stored in a computer for later analysis.

The present invention has been described in relation to several preferred embodiments. One of ordinary skill, after reading the foregoing specification, may be able to effect various other changes, alterations and substitutions of equivalents without departing from the broad concepts disclosed. It is therefor intended that the scope of letters patent granted hereon be limited only by the definitions contained in the appended claims and the equivalents thereof.

The embodiments of the invention in which an exclusive property or privilege is claimed are defined as follows:

1. A basketball shooting and return center supported by an overhead support structure, comprising:

a backboard structure;

a plurality of goals mounted on the backboard structure;

a ball return table connected to the backboard structure, configured to form a plurality of troughs, each trough disposed under at least one associated goal and sloping downwardly towards a discharge point defined by the trough, wherein the ball return table includes:

(a) a peripheral frame secured to the backboard structure under the goals; and (b) a web spanning and attached to the frame;

suspension means for suspending the backboard structure and the ball return table from the overhead support structure; and at least one elongate ball rack, secured to the ball return table adjacent the discharge point of an associated trough, for receiving returned balls from the trough and directing the returned balls to the user from the distal end of the ball rack, wherein the ball rack is pivotally secured to the ball return table on a first pivot axis, and which further comprises means to selectively position the ball rack at selected angular positions about the first pivot axis, the means to selectively position the ball rack including an elongate telescoping support arm pivotally secured to the ball rack at a point spaced from the first pivot axis, the support arm being adjustable in length to selectively elevate the ball rack.

2. The basketball shooting and return center of claim 1, wherein the ball rack is selectively pivotable to a vertical position, in which the ball rack depends downwardly from the ball return table.

3. The basketball shooting and return center of claim 2, wherein:

the ball rack includes a tubular portion; and the support arm includes a first portion secured to the ball rack and a terminal portion formed at a generally right angle relative to the first portion, the terminal portion being capable of being positioned, when the ball rack is in the vertical position, to retain returned balls in a stack within the tubular portion of the ball rack for individual removal from the ball rack.

4. A basketball shooting and return center supported by an overhead support structure, comprising:

a backboard structure;

a plurality of goals mounted on the backboard structure;

a ball return table connected to the backboard structure, configured to form a plurality of troughs, each trough disposed under at least one associated goal and sloping downwardly towards a discharge point defined by the trough, wherein the ball return table includes:

(a) a peripheral frame secured to the backboard structure under the goals; and (b) a web spanning and attached to the frame;

suspension means for suspending the backboard structure and the ball return table from the overhead support structure; and at least one elongate ball rack, secured to the ball return table adjacent the discharge point of an associated trough, for receiving returned balls from the trough and directing the returned balls to the user from the distal end of the ball rack, wherein the ball rack is pivotally secured to the ball return table on a first pivot axis, and which further comprises means to selectively position the ball rack at selected angular positions about the first pivot axis, the ball rack being pivotable to a position under and substantially parallel to the ball return table for storage.

5. A basketball shooting and return center, comprising:

a backboard structure;

a plurality of goals mounted on the backboard structure;

ball return means associated with the backboard structure for capturing balls thrown by a user at the goals and returning the captured balls to the user;

at least one elongate ball rack pivotally secured to the ball return means on a first pivot axis for directing balls captured by the ball return means to the user from the distal end of the ball rack;

means to selectively position the ball rack at selected angular positions about the first pivot axis, wherein the means to selectively position the ball rack comprises an elongate telescoping support arm pivotally secured to the ball rack at a point spaced from the first pivot axis, the support arm being adjustable in length to selectively elevate the ball rack about the first pivot axis.

6. The basketball shooting and return center of claim 5, wherein the ball rack is selectively pivotable to a vertical position, in which the ball rack depends downwardly from the ball return means.

7. The basketball shooting and return center of claim 6, wherein:

the ball rack includes a tubular portion; and the support arm includes a first portion secured to the ball rack and a terminal portion formed at a generally right angle relative to the first portion, the terminal portion being capable of insertion into the ball rack, adjacent the tubular portion of the ball rack, when the ball rack is in the vertical position to enable balls to be received in a stack within the tubular portion of the ball rack for individual removal form the ball rack.

8. A basketball shooting and return center supported by an overhead support structure, comprising:

a backboard structure;

a plurality of goals mounted on the backboard structure;

a ball return table connected to the backboard structure;

suspension means for suspending the backboard structure and the ball return table from the overhead support structure; and at least one elongate ball rack secured to the ball return means for directing balls captured by the ball return means to the user from the distal end of the ball rack, wherein the ball rack is pivotably secured to the ball return means on a first pivot axis, and is pivotable to a storage position under and substantially parallel to the ball return table, the ball rack further comprising means to selectively position the ball rack at selected angular positions about the first pivot axis.

9. A basketball shooting and return center supported by an overhead support structure, comprising:

a backboard structure;

a plurality of goals mounted on the backboard structure;

a ball return table connected to the backboard structure; and suspension means for suspending the backboard structure and the ball return table from the overhead support structure;

at least one elongate ball rack secured to the ball return means for directing balls captured by the ball return means to the user from the distal end of the ball rack;

a ground engaging extension rack disposed adjacent the remote end of the ball rack; and a flexible conduit connected between the remote end of the ball rack and the extension rack to funnel balls from the ball rack onto the extension rack.

10. A portable basketball shooting and return center, comprising:

a portable base;

a backboard structure pivotally secured to the base to pivot between a lowered position for storage and an elevated position for use, the backboard structure defining a bearing surface;

a plurality of goals mounted on the backboard structure;

ball return means associated with the backboard structure for capturing balls thrown by a user at the goals and returning the captured balls to the user; and lift means mounted on the base and contacting the bearing surface of the backboard structure for powered pivoting of the backboard structure from the lowered position to the elevated position.

11. The basketball shooting and return center of claim 10 wherein the lift means comprises a hydraulic lift mounted on the base that is extendible to raise the backboard structure.

12. The basketball shooting and return center of claim 10 wherein:

the base comprises a trailer;

the ball return means comprises a hinged ball return table that folds for storage; and the backboard structure and the ball return table fold inwardly into the trailer.

13. The basketball shooting and return center of claim 10 wherein:

the base includes an upright member;

the backboard structure is pivotally secured to the upright member of the base; and the ball return means comprises a ball return table pivotally connected along a first edge to the backboard structure, the ball return table being hinged between the connected first edge of the ball return table and an opposing second edge of the ball return table, thereby enabling the ball return table to fold with the second edge of the ball return table approaching the first edge of the ball return table when the backboard structure is lowered for storage.

14. A basketball shooting and return center supported by an overhead support structure, comprising:

a backboard structure;

a plurality of goals mounted on the backboard structure;

a ball return table pivotally connected to the backboard structure to pivot between a lowered position for capturing and return of balls and an upper position for storage; and suspension means for suspending the backboard structure and the ball return table from the overhead support structure, operable to pivot the ball return table to the upper position and to raise the ball return table while in the upper position and backboard structure for elevated storage.

15. The basketball shooting and return center of claim 14, further comprising at least one support leg pivotally secured to the ball return table and pivotable between a downwardly depending position for support of the ball return table and a storage position, in which the support leg is folded under and substantially parallel to the ball return table.

16. The basketball shooting and return center of claim 14, wherein the suspension means comprises:

at least one cable engaging means mounted on the backboard structure;

a cable having a first end engaged with the overhead structure and a second end secured to the ball return table, the cable being engaged with the cable engaging means between the cable's first and second ends; and means for drawing the cable to raise the backboard structure and ball return table toward the overhead structure and to cause the ball return table to pivot upwardly toward the backboard structure.

* * * * *